United States Patent [19]

Nitzberg

[11] 4,205,881

[45] Jun. 3, 1980

[54] MACHINE AND METHOD FOR MINING HARD MATERIAL IN-SITU BETWEEN ADJACENT AUGER HOLES

[75] Inventor: Leonard R. Nitzberg, Knoxville, Tenn.

[73] Assignee: Patent Development, Ltd., Knoxville, Tenn.

[21] Appl. No.: 894,424

[22] Filed: Apr. 7, 1980

[51] Int. Cl.[2] ..... E21C 27/24

[52] U.S. Cl. ..... 299/18; 299/57; 299/67; 175/91; 175/326

[58] Field of Search ..... 299/57, 67, 18; 175/91, 175/326

[56] References Cited

U.S. PATENT DOCUMENTS

| | | | |
|---|---|---|---|
| 2,026,062 | 12/1935 | Reilly | 175/326 X |
| 2,430,364 | 11/1947 | Peale et al. | 299/57 |
| 3,922,015 | 11/1975 | Poundstone | 299/18 X |

FOREIGN PATENT DOCUMENTS

| | | | |
|---|---|---|---|
| 234302 | 10/1969 | U.S.S.R. | 299/57 |

*Primary Examiner*—Ernest R. Purser
*Attorney, Agent, or Firm*—Pitts & Kesterson

[57] ABSTRACT

A machine for mining hard material in-situ between adjacent auger holes is disclosed which is suitable for being drivingly connected to a conventional mining apparatus, particularly an auger mining apparatus. The mining machine includes cutting apparatus for mechanically contacting and dislocating hard material in-situ between adjacent auger holes. A power operated system is drivingly connected to the cutting apparatus for generating a cutting motion during the in-cutting operation. A guiding system is provided for maintaining the cutting apparatus in mechanical contact with hard material in-situ between the adjacent auger holes. In one embodiment of the invention a collection bin collects the dislocated material which is transported from the position at which the material is mined to a remote location for deposit.

34 Claims, 6 Drawing Figures

MACHINE AND METHOD FOR MINING HARD MATERIAL IN-SITU BETWEEN ADJACENT AUGER HOLES

This invention relates to a mining machine and method for removing coal, ore or another similar hard material, and more specifically concerns a mining machine and method for the removal of hard materials in-situ between adjacent auger holes.

During auger mining operations, auger holes are bored into a seam of hard material such as coal, ore or the like at spaced locations leaving pillars or partitions of hard material in-situ between adjacent auger holes. The auger holes must be spaced far enough from each other to prevent the intersection of any two normally non-parallel holes. When intersection occurs between the normally non-parallel auger holes, the hard material product being conveyed by the conveyor portion of the auger is spilled into the void of the intersected auger hole and wasted. Moreover, when coal and other stratified or brittle deposits have had their sections thinned and subjected to shock and/or vibration, the bearing strengths of the formations is significantly reduced. To prevent the collapse of the auger holes under the weight of the overburden, certain practical and at times legal minimum partition thicknesses have been established. In mining by such augering methods, the maximum amount of product is not recovered inasmuch as the spacing between the holes which is designed to prevent the intersection of adjacent auger holes is greater than is necessary to bear the overburden. Moreover, it is not practical to mine the partitional structures formed by the auger holes which are unnecessary for bearing the overburden by conventional mining apparatuses which impart substantially vertical cutting forces to the coal seam, since these forces alone may result in a collapse of the auger holes.

According to the present invention, a machine and method are provided for the removal of certain selected partitions of hard material in-situ between adjacent auger holes thereby enhancing the yield from a previously mined seam while leaving adequate and legally sufficient support for the overburden. Moreover, the method and machine of the present disclosure operate with cutting forces which reduce the cutting load, that is the cutting stresses and vibrations, applied to the adjacent formations thereby protecting the strength of such formation which reduces the likelihood of a auger hole collapsing during the cutting operation. Further, the method and machine do not impart significant lateral forces incidental to the cutting operation, upon supporting partitions if such partitions are not completely removed and the valuable ore recovered. Still further, the machine and method do not slenderize or change the configuration of supporting partitions left after reworking the augered ore seams and reduce the subjection of adjacent supporting partitions to lateral forces incidental to the cutting operation.

Forward propulsion and power for driving the cutting means is supplied through conventional mining equipment located outside the mining area thereby eliminating the presence of operators or elaborate guidance systems in the immediate mining area. In this connection, the safety of operating personnel is enhanced and the economic loss resultant from overburden collapse is reduced. Inasmuch as the machine is suitable for being drivingly connected to a conventional mining apparatus, and particularly a augering apparatus, the yield from an ore deposit can be significantly increased with a relative small increase in capital investment.

The machine and method are adapted for recovering ore on the in-cutting operation in a previously auger mined deposit and define a capture area which assists in preventing the escape or waste of the ore. The ore or hard material dislocated by the apparatus is deposited directly in the line of travel of a collector bin and conveyor which collects and transports the cut product to a location remote to the reworked hole for deposit. Moreover, the power for propulsion and driving the cutting means is preferrably provided along a single drive shaft such as the shaft of a conventional auger member which is rotatably driven by an existing auger drive apparatus.

Other objects and advantages of the machine and method will become apparent upon reading the following description and claims together with the drawings in which:

Accordingly, a mining machine is provided which is suitable for being drivingly connected to a conventional mining apparatus. The mining machine includes cutting means for mechanically contacting and dislocating hard material in-situ between adjacent auger holes. Power operated means is drivingly connected to the cutting means for generating a cutting motion during the in-cutting operation. The guide means are provided for maintaining the cutting means in mechanical contact with hard material in the in-cutting operation. In one embodiment of the invention, a collection bin is provided for collecting the dislocated material and for directing the material into means for carrying the dislocated material away from the position at which the material is mined.

A method for removing had material in-situ between adjacent auger holes on the in-cutting operation is disclosed which comprises the steps of advancing a mining machine along the length of the hard material between the adjacent auger holes. The mining machine is driven in a cutting motion such that the machine dislocates the hard material as the machine is advanced. During the cutting operation, the machine is guided such that it mechanically engages and dislocates the material. In one embodiment, the hard material is collected subsequent to its being dislocated and carried to a remote location.

Figure 1:
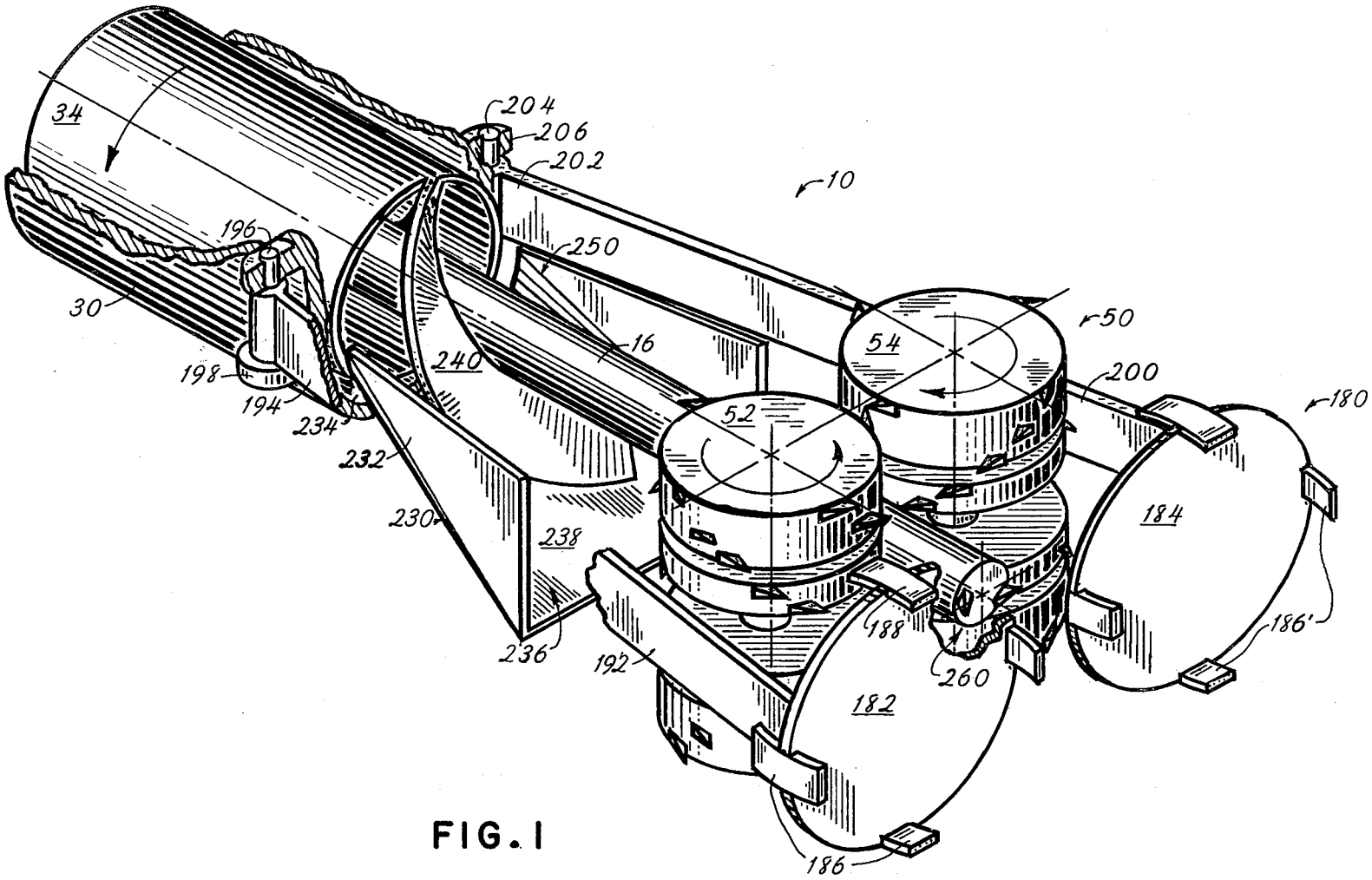
FIG. 1 is an isometric, schematic view of a machine constructed in accordance with various features of invention with a portion of the machine broken away for illustrative purposes.

Referring now to the Figures, a coal mining machine constructed in accordance with various features of the invention is designated generally at 10 in FIG. 1. The illustrated machine 10 is suitable for being driven by a conventional auger mining apparatus and is mounted on the out-board end portion of a conventional auger member 12 having a helical blade 14 carried by the shaft 16. The apparatus 10 is designed to remove hard material 18 such as coal, ore or the like in-situ between adjacent, preexisting auger holes such as the holes 20 and 22 bored into the coal seam 24 which is shown to be disposed between the overburden 26 and the underburden 28. Normally, these bores 20 and 22 commence at the substantially upright face of the seam extending into the side of a mountain or hill.

The machine 10 includes a main housing 30 which defines an elongated bore 32 that receives the rotating cover 34 of auger member 12. The auger member 12 including the cover 34 are rotatably received within the bore 32 of the housing 30 and to facilitate rotation of the cover 34 with respect to the housing 30. A bearing 36 is interposed between the inner surface 38 of the housing and the external surface 40 of the cover 34. The inner and outer races of the bearing 36 are secured to the cover 34 and housing 30, respectively, to assist in preventing longitudinal movement of the housing with respect to the auger member 12 during the in-cutting operation, i.e. when the machine is advanced into the seam under thrust provided by the conventional auger apparatus. A stop 42 carried by the housing serves to prevent longitudinal movement of the housing 30 relative to the cover 34 during withdrawal of the apparatus from a coal seam. In this connection, the annular stop 42 engages the cooperating annulus 44 secured as by welding to external surface 40 of the cover to limit the travel of the housing 30 as the apparatus is withdrawn from the seam. As necessary or desired, a conventional bearing can be interposed between the annulus 44 and the section of the stop 42 which engages the annulus to reduce friction between these members upon rotation of the auger member 12.

It will be recognized that the bearing 36 and the stop 42 secure the apparatus 10 in a fixed longitudinal position with respect to the auger member 12 while leaving the cover and auger member free to rotate within the housing bore 32.

In order to mechanically contact and dislocate hard material in-situ between adjacent auger holes cutting means generally indicated at 50 is provided. In the illustrated embodiment, the cutting means comprises a pair of cutting drums 52 and 54 which are carried substantially along their respective central axes by the shafts 56 and 58, respectively. The cooperating pair of drums 52 and 54 define a nip 60 therebetween which is substantially aligned with the hard material in-situ between adjacent auger holes as the mining machine is advanced into the coal seam during the in-cutting operation. Each of the drums are provided with a multiplicity of cutting elements such as the cutting elements **62*a*, 62*c* and 62*e* on drum 52 and 62*b*, 62*d* and 62*f* on drum 54**. These cutting elements are of conventional design and project outwardly from the surface of the drums such that during rotation of the drums during the in-cutting operation, the cutting elements mechanically contact and dislocate hard material disposed between adjacent auger holes.

Figure 4:
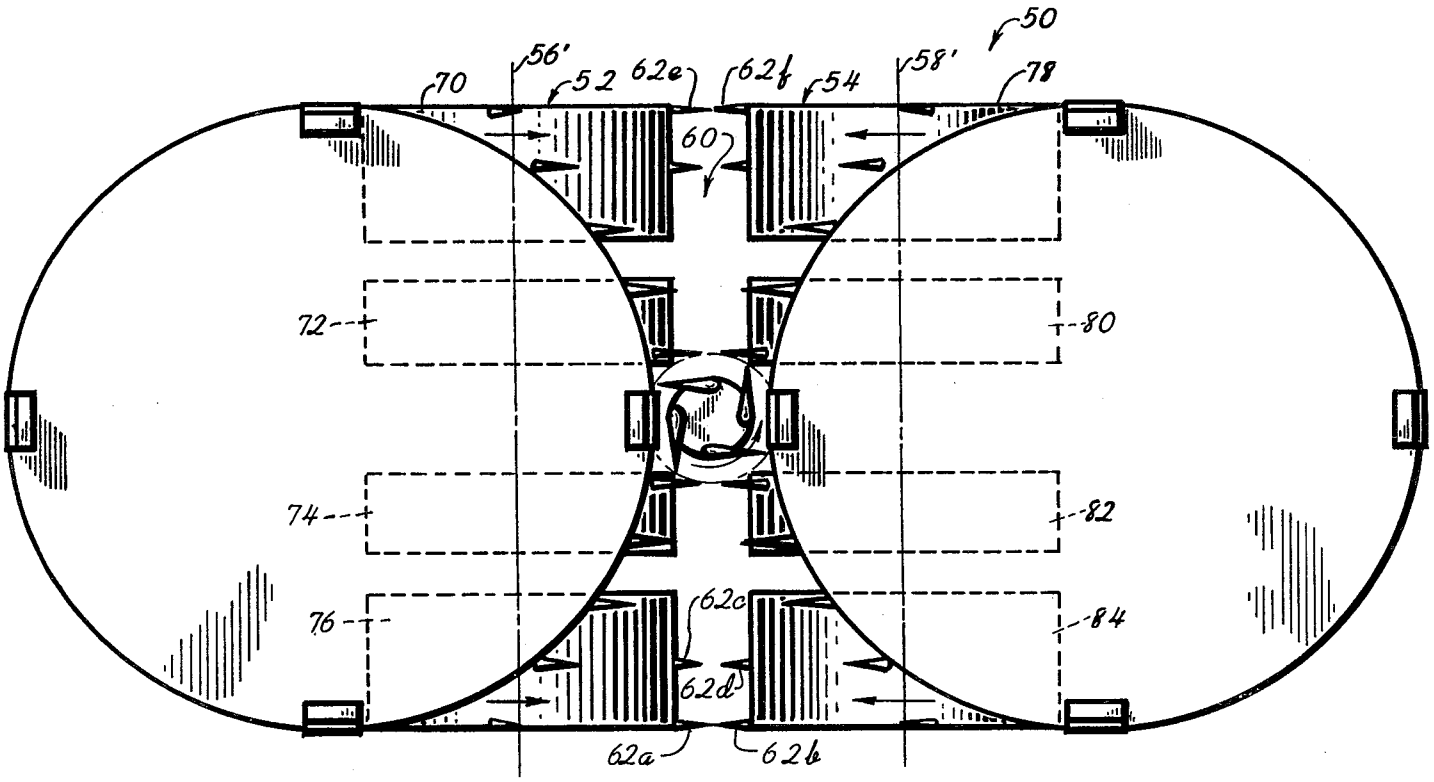
FIG. 4 is a front elevation view of the machine shown in FIG. 1.

As shown in FIG. 4 the drum 52 comprises a plurality of sections 70, 72, 74 and 76 which are coaxial and mounted at space location along the shaft 56 which is illustrated diagramatically at 56' in FIG. 4. Similarly, the drum 54 includes a plurality of sections 78, 80, 82 and 84 disposed coaxially and mounted at space locations along the length of the shaft 58 illustrated diagramatically at 58' in FIG. 4. The cooperating sections of the drums 52 and 54, such as sections 70 and 78, respectively, dislocate hard material mechanically contacted by these cooperating drum sections as the material is moved into the section of the nip defined between the cooperating drum sections. By spacing the drum sections along the axes of the shafts 56 and 58, complete recovery of the hard material in-situ between adjacent auger holes can be accomplished while the recovered chunks are of a larger size. It will be recognized by those familiar with mining operations, that the recovery of larger size chunks that normally result in a more profitable mining program and reduce the liklihood of clogging or jamming the mining equipment.

Figure 2:
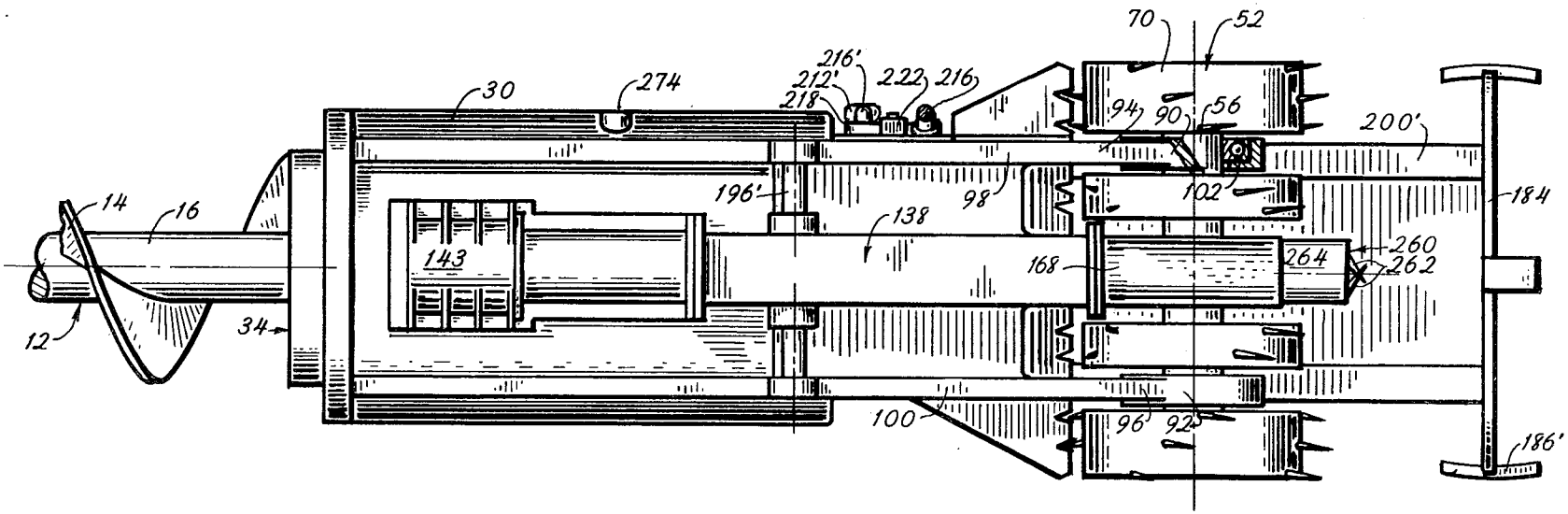
FIG. 2 is a side elevation view of the machine shown in FIG. 1 with one of the guides and its supporting member removed.

As shown in the Figures, the illustrated drums 52 and 54 are rotatably mounted about substantially parallel axes. In this connection, the shafts 56 and 58 are each journalled at space locations along the length of the respective shafts at the outboard end postion of support members which are integrally formed at their opposite ends and form a part of the housing 30. More specifically, the drum 52 is rotatably supported at space locations in the bearing housings 90 and 92 (see FIG. 2) intergally formed with the outboard end portion 94 and 96 of the support members 98 and 100, respectively. The opposite end portion of support member 98 is intergally formed with the housing 30 and the opposite end portion of the support member 100 is integrally formed with the housing 30. Inasmuch as the drum 54 is supported in a substantially similar manner, the details of supporting drum 52 will suffice to describe the manner in which drum 54 is supported. As shown in FIG. 2, the housing 90 carried by the end portion 94 of the support member 98 is provided with a bearing 102 having an internal race which engages the shaft 56, and the external race of this bearing engages the bearing housing 90. The bearing housing 92 contains a similar bearing. During the incutting operation, the axes defined by the shafts 56 and 58 about which the drums 52 and 54 respectively, rotate are disposed substantially vertical to assist in preventing the cutting forces generated by the cutting means from imparting a vertical load to the overburden which might otherwise cause a collapse of the overburden into the reworked bore created by the in-cutting operation.

In order to drive the cutting means during the cutting operation, power operated means are provided. In the illustrated embodiment, power is transmitted through the conventional auger member 12 which is rotatably driven at its opposite end by a conventional mining apparatus. As the auger member 12 rotates the auger cover 34 also rotates and supplies a power takeoff for driving the drums 52 and 54 during the in-cutting operation. More specifically, a gear 120 is carried by the cover 34 and received substantially within the bore 32 defined by the housing 30. This gear 120 serves as a power takeoff for the drive trains generally indicated at 122 and 122' which serve to impart rotational forces to the shafts 56 and 58, respectively for rotatably driving the drums 52 and 54, respectively. Inasmuch as the drive trains 122 and 122' are substantially identical a detailed description will be provided for the drive train 122 with the corresponding prime numbers referring to substantially identical portions of the drive train 122'. It will however, be recognized that the drive train 122 serves to rotate the drum 52 in a counterclockwise direction as seen in FIG. 1 while the drive train 122 serves to rotate the drum 54 in a clockwise direction as seen in FIG. 1.

More particularly, the drive train 122 includes an elongated shaft 126 having shaft sections 128 and 130 which are interconnected by a universal joint 132 of conventional design. The opposite end of the shaft section 130 is connected to a further shaft section 134 by a further universal joint 136. The shaft section 128 is rotatably received within the housing section 138 which is intergally formed with the main housing 30. This housing section 138 carries a pair of bearings 140 and 142 in the housing portion 143, which serve to rotatably receive the shaft section 128 therein. A pinion gear 146 is interposed between the bearings 140 and 142 and meshes with the gear 120 carried by the cover 34. The housing section 138 defines a cavity 150 together with the main housing 30 which receives the shaft 126 and encases the shaft such that the shaft can rotate within an oil bath as necessary or desired.

The housing section 138 defines at its outboard end portion 160 a gear housing which contains a worm gear 162 carried by section 134 of the driveshaft. This worm gear 162 is interposed between bearings 164 and 166 which rotatably mount the shaft section 134 in the gear housing, indicated generally at 168. The bearing housing 168 includes a substantially circular section 170 which carrys a substantially circular gear 172 which meshes with and is driven by the worm gear 162 and which is secured at its central portion to the shaft supporting the drum, that is the drum 52 supported on the shaft 56. The drum 54 is supported on the shaft 58 and is driven by the drive train 122 through the gears 162' and 172'. As indicated in FIG. 2 the drive train 122 is drivingly connected to the shaft 56 substantially at the mid-portion of the shaft.

Figure 3:
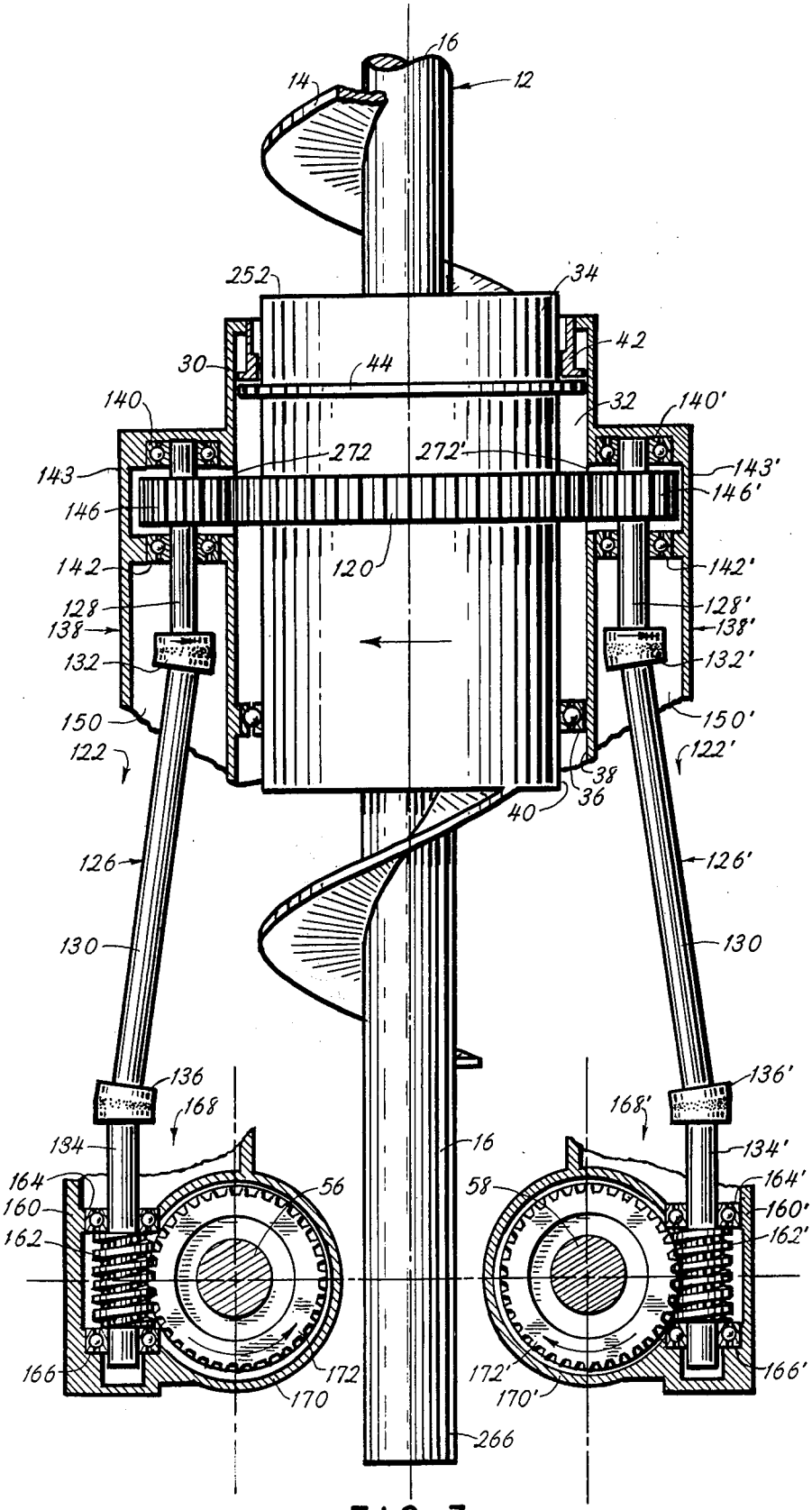
FIG. 3 is a sectional view of the machine shown in FIG. 1 illustrating the drive trains for the cutting means with portions of the drive train housings broken away.

As indicated by the rotational direction arrows in FIGS. 1 and 3 the drums 52 and 54 are rotated inwardly and in opposite direction such that the hard material dislocated during the in-cutting operation is directed rearwardly of the mining machine.

Means are provided for advancing the mining machine 10 along the length of the hard material in-situ between adjacent auger holes such that the cutting means mechanically contacts and dislocates the hard material on the incutting operation. In the preferred embodiment, the mining machine 10 is advanced along the length of the hard material to be mined by thrust forces exerted on the shaft 16 by a conventional mining apparatus such as a coal augering machine positioned externally with respect to the opening into which the mining machine 10 is disposed. It will be recognized by those skilled in the art that as the mining machine 10 is advanced into the seam opening during the in-cutting operation, additional auger sections will be added in a conventional manner such that the mining machine can be extended along the length of the hard material partition to be mined. The mining machine outline as shown in FIG. 4 is proportioned for being received in the space defined by adjacent auger holes and the void created during the in-cutting operation. Moreover, inasmuch as the thrust forces for advancing the machine into the coal seam are supplied from a power operated conventional mining apparatus disposed externally to the mine opening, the machine advancement can be controlled by an operator or operators positioned externally to the mine opening and therefore the machine operators are less likely to be exposed to injury. The in-cutting operation will continue under normal conditions until the cutting means of the mining machine enter the overburden, underburden or an adjacent auger hole at which time the machine 10 will be withdrawn by the sequential removal of auger sections in a conventional manner.

Means are provided for guiding the mining machine 10 and maintaining cutting means in mechanical contact with hard material in-situ between adjacent auger holes as the machine is advanced during the in-cutting operation. In the illustrated embodiment, the guide means generally designated at 180 includes a pair of guides 182 and 184. Guide 182 is proportioned for being inserted into the auger hole 20 and guide 184 is proportioned for being inserted into the adjacent auger hole 22 such that each of the guides advances along the length of its respective auger hole as the mining machine is advanced along the length of the hard material 18 during the in-cutting operation. More specifically, the guides 182 and 184 in the illustrated embodiment comprise disc-shaped members each of which carries a plurality of skids 186 which are spaced annularly about the perimeter of the disc-shaped members. These skids assist in preventing the disc-shaped members from becoming bound by the rough surface of the auger hole and consequently reduces the irregular forward motion of the cutting means during the incutting operation. Each of the skids 186 and 186' includes one surface such as surface 188 in FIG. 1 which is arcuate and slides along the inner surface of the auger hole during the in-cutting operation. Preferably, the surface 188 forms a sperical section which enhances the sliding motion of the guides.

In the preferred embodiment each of the guide means defines a cross-sectional outline substantially identical to and less than the cross-sectional outline of the auger hole in which the guide means is received. To this end, the guide means defines a capture area proximate the cutting means which enhances the amount of the dislocated hard material collected thereby eliminating waste and lost profits.

The guide 182 is supported at the outboard end portion of a support member 192 (see FIG. 1) which is pivotably supported at its opposite end 194 by a pin 196 secured in the clevis member 198 which is carried by the housing 30. Similarly, the guide 184 is carried by the outboard end portion of the support member 200 which is pivotally supported at its end portion 202 by a pin 204 received in the clevis member 206 which is carried substantially diametrically across the housing from the clevis member 198. An alternate embodiment of the support member 192 is shown at 192' in FIG. 5 which is pivoted at its end portion 194' on the hinge pin member 196'. Similarly, an alternate embodiment of the support member 200 is indicated at 200' in FIG. 5 and is supported at its end portions 202' by the hinge pin 204'. It will be recognized that the end portions 194' and 202' can be pivotally mounted on the housing by separate sections of coaxially aligned hinge pins to provide additional strength as necessary or desired.

As described more generally above, the guides 182 and 184 are substantially identical but less than the cross-sectional outline of the auger holes along which the guides move during the cutting operation. These guides serve to push contaminants such as a large mass of foreign matter, a tree stump for example, ahead of the machine during the in-cutting operation. In this connection, the guides assist in preventing contamination of the yield and protect the cutting elements from damaging contaminants.

Figure 5:
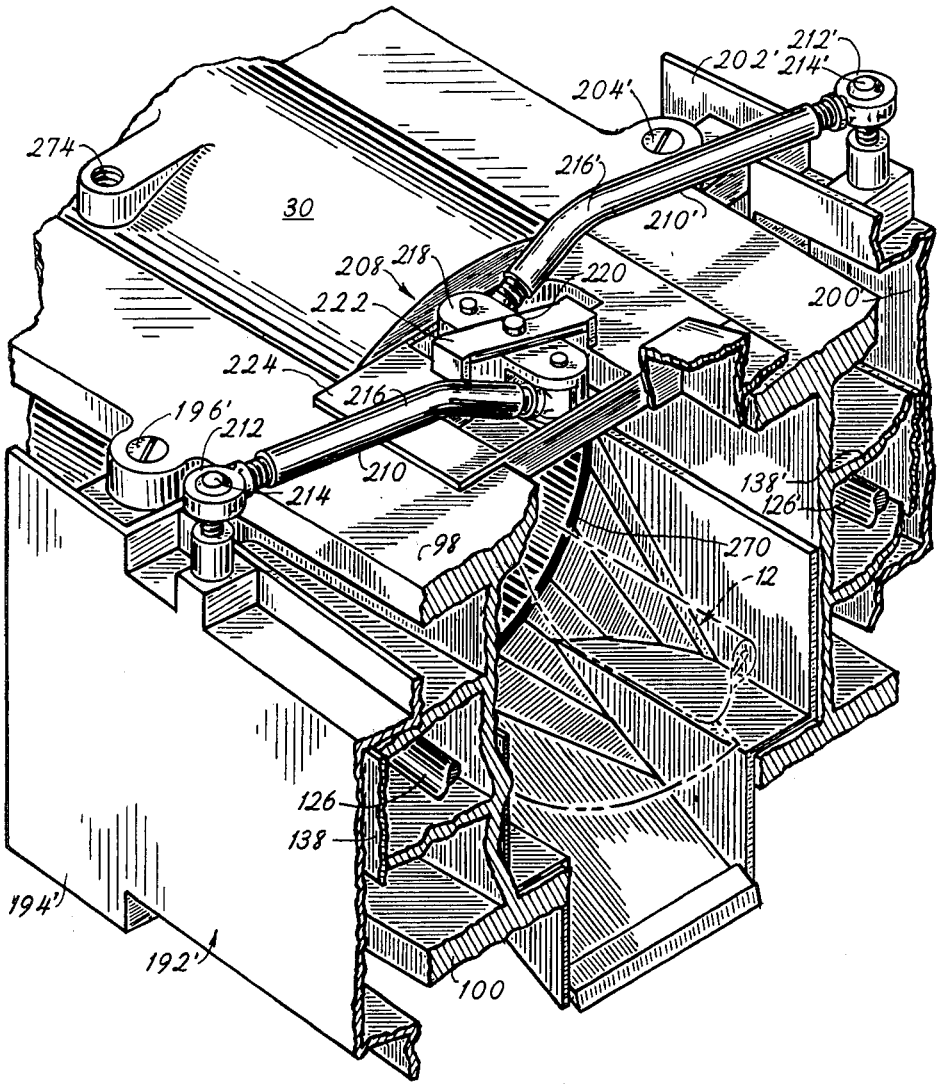
FIG. 5 illustrates a portion of the machine shown in FIG. 1 with sections broken away to illustrate the internal portion of the housing.

Means are provided for positioning each of the guides 182 and 184 such that the cutting means 50 is maintained in substantial alignment with the hard material insitu between adjacent auger holes as the machine 10 is advanced during the in-cutting operation. More specifically, positioning means generally indicated at 208 serves to keep each of the guides 182 and 184 substantially equidistant from the centerline of the machine 10 such that the hard material 18 is received substantially at its central portion within the nip 60 defined between the drums 52 and 54. To this end, connecting rods 210 and 210' are pivotally connected at their outboard end portions to the support members 192' and 200', respectively through rod end bearings 212 and 212'. More specifically, the end bearing 212 is connected to the support member 192' through the hinge pin 214 and the rod end bearing 212' is connected to the arm 200' through the hinge pin 214'. The opposite end portions 216 and 216' of the connecting rods are joined to each other by a direction reversing lever 218 which is pivotally connected to the non-rotatable housing 30 by the pin member 220 secured at one of its ends in a suitable bore or the like provided in the housing and secured at its opposite end in the bracket 222 which is substantially U-shaped and joined at its opposite end portions to the housing as by welding, bolts, or the like. To this end, movement of either of the guides 182 or 184 relative to the non-rotating housing or body member 30 imparts an equal but opposite movement of the other guide through its corresponding supporting member. In this connection there is a resultant constant alignment of the housing 30 with the hard material in-situ between adjacent auger holes such that this hard material to be dislocated passes within the nip 60 between the cutting drums. As shown in FIG. 5, the positioning means 208 is carried at its central portion by a support plate or bracket 224 mounted on the housing.

Means are provided for collecting the hard material subsequent to its being dislocated by the cutting action of the cutting drums 52 and 54. More specifically, a collection bin or hopper generally indicated at 230 is disposed behind the cutting means with a respect to the direction the machine 10 is advanced during the in-cutting operation. This bin 230 is substantially U-shaped in cross-sectional outline as shown in FIG. 1 and tapered toward its end portion 232 which is rigidly secured to the housing 30 as by suitable spacers 234 or the like. The mouth 230 of the hopper receives hard material dislocated by the cutting action of the drums 52 and 54. Moreover, the bin 230 serves to scoop any dislocated hard material from the lower surface of the area defined by removal of the hard material in-situ between the adjacent auger holes. Hard material collected by the bin 230 is directed along the length of the bin into the auger cover 34. In this connection, a section of the shaft 16 which extends through the bin 230 at a space location above the base plate 238 of the bin, is provided with an auger blade section 240 which serves to remove the dislocated material from the bin.

While a tapered bin having a substantially U-Shaped cross-section is illustrated in FIG. 1, it will be recognized to those skilled in the art that the bin configuration can be altered as necessary or desired to enhance the efficiency of the collection process, or conform to the floor of the reworked mine opening. For example, the bin 230 could be substantially conical in shape and completely circumscribe the section of the auger extending through the bin. Moreover, it will be recognized that the guides and the collection bin define a capture area together with the side walls of the auger hole in which the cutting drums are located such that during the cutting operation only small amounts of the dislocated hard material are thrown from the capture area with a resultant substantially complete collection of the dislocated hard material cut a way by the cutting means.

In the preferred embodiment means are provided for carrying the dislocated hard material away from the position at which said material is dislocated to a remote location external to the mine opening where the material is deposited and removed by trucks. In the illustrated embodiment the carrying means generally designated at 250 is positioned behind and in communication with the collection bin 230 such that as the dislocated hard material is collected within the bin 230 the hard material is removed from the bin and continuously carried to a remote location. More specifically, the illustrated carrying means comprises the auger member 12 which includes the blade section 240 that extends within the collection bin 230. Dislocated hard material gathered by the blade section 240 is transmitted rearwardly of the mining machine during rotation of the auger member 12 together with the auger cover 34 and the shaft 16. This auger member 12 is rotatably driven by a conventional mining apparatus such as a crowder head and the rotational forces imparted to the auger member serve to convey the dislocated material from the cutting site. As the dislocated material exits the end portion 252 (see FIG. 3) of the auger cover 34 the material normally enters a further auger cover, communicating with the opened end portion 252 of cover 34, which surrounds the adjacent section of the auger member 12 and guides the material to a remote location for deposit.

In one embodiment of the invention, the cutting means includes a cutting head generally desinated at 260 in FIG. 1 having a plurality of cutting elements 262 which rotate about an axis substantially parallel with the direction of movement of the machine during the in-cutting operation. More specifically, the illustrated cutting head 262 comprises the outboard end portion 266 of the auger member shaft 16 which is rotatably driven by the conventional mining apparatus. As shown in FIG. 2, this cutting head in one embodiment is disposed in front of the cutting drums 52 and 54 with respect of the direction of movement of the machine during the in-cutting operation. Moreover, as can be seen in FIG. 4, the cutting head 260 carried by the shaft 16 extends between sections 72 and 74 of the drum 52 and sections 80 and 82 of the drum 54. The embodiment shown in FIG. 4 includes four cutting elements 262 however, it will be recognized by those skilled in the art that various numbers of cutting elements can be used.

Figure 6:
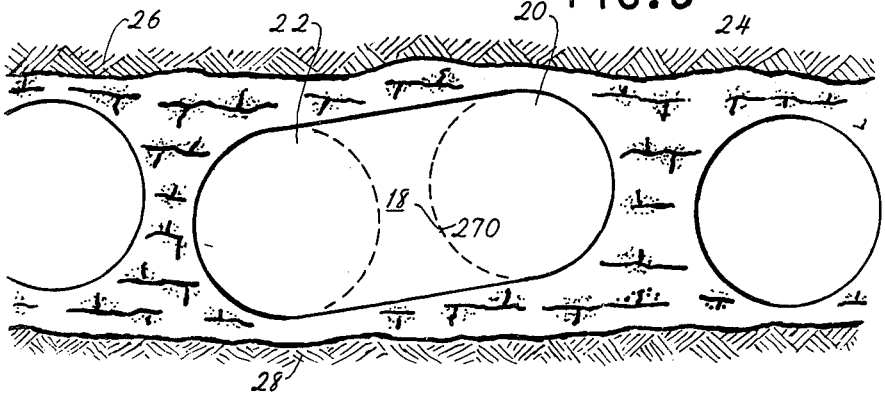
FIG. 6 is a schematic view of a coal seam disposed between overburden and underburden, with pre-existing auger holes bored into the seam and depicts the hard material in-situ between adjacent auger holes which is recovered by the present machine.

During the cutting operation the cutting head 262 cuts a void into the hard material 18 substantially at the location indicated at 270 in FIG. 6 which is between the upper and lower portion of the hard material partition between the auger holes 22 and 20. In this connection, the cutting forces transmitted to the overburden 26 by the cutting drums 52 and 54 which follow the cutting head 260 is reduced with a resultant reduction in the likelihood of a collapse of the overburden during the mining operation. Moreover, by cutting a void into the area indicated at 270 in the hard material partition, the size of the lumps resultant from dislocating the remaining hard material by the drums 52 and 54 is increased with a resultant reduction of the cutting load or forces transmitted to the overburden.

Inasmuch as the cutting head 260 enhances the size of the lumps dislocated during the mining operation, the rate of forward advancement of the mining machine 10 during the in-cutting operation can be increased with a concommitant increase in the yield of the dislocated hard material per hour.

To assist in reducing friction between the various moving parts in the housing 10, an oil bath can be maintained within the bore 32 and the cavities 150 and 150' defined by the housing section 138 and 138'. To this end, an oil seal 270 can be interposed between the external surface of the cover 34 and the surface 38 of the housing to prevent oil from escaping the confines of the bore 32. A further oil seal can be disposed at a spaced location from the seal 270 and between the cover 34 and housing 30 to assure trapping the oil between these seals such that the oil bath is maintained around the gear 120 and the driven gears 146 and 146'. Oil can enter the housing sections 138 and 138' through the openings 272 and 272' and pass through the bearings 142, 164 and 142' and 164' to provide an oil bath for the various gears and shafts in the drive trains 122 and 122'. Oil can be introduced into the bore 32 through the port 274 in the housing which can be plugged and drawn from the bore 32 from a further port located on the underside of the housing 30.

From the foregoing detailed description, it will be recognized that a machine and method for mining coal having various advantages over known prior art has been shown and described. More specifically, the illustrated mining machine is particularly adapted for being drivingly connected to a conventional mining apparatus such as the crowder head of an auger machine. The conventional mining apparatus provides the power for driving cutting means and for advancing the machine into the coal seam. The machine is particularly adapted for mining hard material insitu between adjacent auger holes. In this connection, a pair of cooperating cutting drums are provided in one embodiment which rotates in opposite directions and inwardly such that hard material disposed between the auger holes is dislocated and thrown toward a collection bin during the in-cutting operation. To enhance the size of the lumps collected, a cutting head is provided which is disposed forwardly of the cutting drums and cuts a void substantially midway between the upper and lower portions of the hard material column. Moreover, the cutting motion of the cutting head and the cutting drums is designed to reduce the cutting load imparted by the cutting forces to the overburden to assist in preventing collapse during the mining operation.

Guides are provided to assure proper alignment of the cutting means with respect to the partition to be mined. The guides further serve to define a capture area into which the dislocated coal falls during the mining operation thereby assisting in preventing waste of the dislocated material. To assist in proper aligning of the cutting means, positioning means are provided which interconnect the guides support members disposed on opposite sides of the main housing such that the nip defined between the cutting drums is maintained in substantial alignment with the upright centerline of the hard material partition which is to be dislocated. Moreover, the guides and positioning means assist in assuring positive alignment of the cutting means with the normally non-parallel adjacent auger holes regardless of their relationship with respect to each other.

Inasmuch as the cutting drums rotate about substantially parallel and substantially vertical axes during the cutting operation, the stress applied to the roof of the recut opening are less likely to loosen portions of the overburden which might otherwise fall into the mining area and contaminate the yield or damage the machine. Moreover, it will be recognized by those skilled in the art that the machine is free to cant as it follows the guides traveling along the normally non-parallel adjacent auger holes. In this connection, the machine will simply rotate slightly about the axis of the auger member 12.

It will be understood that although a preferred embodiment of the present invention has been illustrated and described, various modifications thereof will become apparent to those skilled in the art, and accordingly the scope of the present invention is defined by the amended claims and equivalents thereof.

What is claimed is:

1. A mining machine suitable for being drivingly connected to a conventional mining apparatus and for removing hard material in-situ between two adjacent auger holes, said machine comprising:

cutting means for mechanically contacting and dislocating hard material in-situ between two adjacent and pre-existing auger holes, power operated means for driving said cutting means said power operated means being connected at one of its ends to said conventional mining apparatus and connected at its opposite end to said cutting means, and guide means for maintaining said cutting means in mechanical contact with said hard material in-situ between two adjacent, pre-existing, non-parallel auger holes, said guide means including one of a pair of guides for inserting into one of said non-parallel auger holes and the other one of said pair for inserting into the other one of said nonparallel auger holes, said pair of guide means being free to move relative to each other such that each one of said pair may advance along the length of the respective adjacent pre-existing, non-parallel auger holes in which it is inserted as said mining machine is advanced along the length of said hard material in-situ between said adjacent auger holes.

2. The machine of claim 1 including means advancing said mining machine along the length of said hard material in-situ between adjacent auger holes such that said cutting means mechanically contacts and dislocates said hard material.

3. The machine of claim 1 for use in mining materials having an overburden wherein said cutting means comprises at least one pair of cooperating cutting drums which define a nip therebetween, said pair of drums having axes maintained substantially perpendicular to a plane defined by the two center lines of said two adjacent auger holes, and said drums being rotatably driven in opposite directions such that cutting forces generated by said cutting means are not impArted to said overburden.

4. The machine of claim 3 wherein each of said drums are equipped with a multiplicity of cutting elements.

5. The machine of claim 3 wherein each of said drums rotates about an axis substantially parallel with respect to the axis about which the other drum rotates.

6. The machine of claim 5 wherein the axis about which the drums rotate are disposed substantially vertically.

7. The machine of claim 3 wherein said cutting means includes a cutting head having a plurality of cutting elements which rotate about an axis substantially parallel with the direction of movement of the machine during the in-cutting operation, said cutting head being disposed in front of said drums.

8. The machine of claim 7 wherein said cutting head comprises a portion of an auger member, said auger member further serving to assist in carrying said material away from the site of its dislocation.

9. The machine of claim 1 including means for collecting said hard material dislocated by said cutting means.

10. The machine of claim 1 or 9 including means for carrying said hard material away from the position at which said material is dislocated by said cutting means.

11. The machine of claim 9 wherein said means for collecting said hard material is located behind said cutting means with respect to the direction said machine is advanced during the in-cutting operation.

12. The machine of claim 9 including means for carrying said hard material away subsequent to its being dislocated by said cutting means, said means for carrying said hard material away being disposed behind and in communication with said means for collecting said hard material.

13. The machine of claim 1 wherein each of said guides comprises a disc-shaped member for being inserted into one of said auger holes.

14. The machine of claim 13 wherein each of said disc-shaped members carries a plurality of skids to assist in preventing said disc-shaped members from becoming bound by the rough surface of the auger hole thereby reducing the irregular forward motion of the cutting means.

15. The mining machine of claim 14 wherein each of said skids include one surface which is arcuate and slides along the inner surface of the auger hole.

16. The mining machine of claim 15 wherein said arcuate surface on each of said skids comprises a substantially spherical outline.

17. The machine of claim 1 including means for positioning each of said guide means such that each of said guide means are kept substantially equidistant from the centerline of said machine whereby said cutting means is maintained in alignment with said hard material in-situ between adjacent auger holes as said machine is advanced.

18. The machine of claim 1 wherein said cutting means includes a cutting head having a plurality of cutting elements which rotate about an axis substantially parallel with the direction of movement of the machine during the in-cutting operation.

19. A mining machine suitable for being drivingly connected to a conventional mining apparatus and for removing hard material in-situ between two adjacent auger holes, said machine comprising:

cutting means for mechanically contacting and dislocating hard material in-situ between two adjacent and pre-existing auger holes, power operated means for driving said cutting means, said power operated means being connected at one of its ends to said conventional mining apparatus and connected at its opposite end of said cutting means, power operated means for advancing said mining machine along the length of said hard material in-situ between said adjacent pre-existing auger holes such that said cutting means mechanically contacts and dislocates said hard material, guide means for maintaining said cutting means in mechanical contact with said hard material in-situ between two adjacent, pre-existing, non-parallel auger holes said guide means including one of a said pair of guides for inserting into one of said non-parallel auger holes and the other one of said pair for inserting into the other one of said non-parallel auger holes, said pair of guides being free to move relative to each other such that each one of said pair may advance along the length of the respective adjacent pre-existing, non-parallel auger holes in which it is inserted as said mining machine is advanced along the length of said hard material in-situ between said adjacent auger holes, and means for carrying said hard material away from the position at which said material is dislocated by said cutting means.

20. The machine of claim 19 for use in mining materials having an overburden wherein said cutting means comprises at least one pair of cooperating cutting drums defining a nip therebetween said pair of drums having axes maintained substantially perpendicular to a plane defined by the axes of said two adjacent auger holes, said drums being rotatably driven in opposite directions such that cutting forces generated by said cutting means are not imparted to said overburden.

21. The machine of claim 19 wherein said mining machine is guided such that said hard material in-situ between said two adjacent auger holes passes into the nip between said cooperating cutting drums as said machine is advanced along the length of said hard material.

22. The machine of claim 19 including means for collecting said hard material subsequent to its being dislocated by said cutting means.

23. The machine of claim 19 wherein each of said guide means defines a cross-sectional outline substantially identical to and less than the cross-sectional outline of the auger hole in which said guide means is received whereby said guide means serves to define a capture area for said dislocated hard material to assist in preventing waste of said dislocated hard material.

24. The machine of claim 19 including means for positioning each of said guide means such that each of said guide means are kept substantially equidistant from the centerline of said machine whereby said cutting means is maintained in alignment with said hard material in-situ between adjacent auger holes as said machine is advanced.

25. A method for removing hard material in-situ between two adjacent auger holes comprising the steps of:

advancing a mining machine along the length of the hard material between two adjacent and pre-existing auger holes, driving said mining machine in a cutting motion such that said machine dislocates said hard material in-situ between said two adjacent, and pre-existing auger holes as said mining machine is advanced, inserting one of a pair of guides into one of said adjacent auger holes, and inserting the other one of said pair in the other one of said adjacent auger holes, moving said pair of guides relative to each other as each of said pair advances along non-parallel portions of said adjacent and pre-existing auger holes, and guiding said mining machine such that said machine follows said adjacent and pre-existing auger holes and mechanically engages the dislocated said hard material in-situ between said auger holes.

26. The method of claim 25 wherein said driving step comprises the steps of positioning a pair of cooperating cutting drums defining a nip therebetween such that the axes of said cutting drums are substantially perpendicular to the plane defined by the axes of said two adjacent auger holes, and rotating said drums in opposite directions.

27. The method of claim 26 wherein said guiding steps comprises the steps of guiding said mining machine such that said hard material in-situ adjacent auger holes passes into the nip between said cooperating cutting drums as said machine is advanced along the length of said hard material.

28. The method of claim 25 including the step of collecting said hard material subsequent to its being dislocated.

29. The method of claim 25 wherein said providing step comprises providing each of said pair with a cross-sectional outline substantially identical to and less than the cross-sectional outline of the auger hole in which said guide means is received, and further comprising the step of defining, by said pair, a capture area for said dislocated hard material to assist in preventing waste of said dislocated hard material.

30. The method of claim 25 including the step of carrying said hard material away from the position at which said material is dislocated by said machine.

31. The method of claim 30 including the step of continuously carrying away said hard material from the position at which said material is dislocated by said machine.

32. The method of claim 25 including the step of withdrawing said mining machine from the space defined by said adjacent auger holes and the void space resulting from removing said hard material from between said holes upon completion of the driving operation.

33. The method of claim 25 including means for maintaining each of said pair equidistant from the centerline of said machine.

34. A method for removing a hard material in-situ between two adjacent auger holes comprising the steps of:

advancing a mining machine along the length of the hard material between two adjacent and pre-existing auger holes, driving said mining machine in a cutting motion such that said machine dislocates said hard material in-situ between said two adjacent, and pre-existing auger holes as said mining machine is advanced, inserting one of a pair of guides into one of said adjacent auger holes and inserting the other one of said pair in the other one of said adjacent auger holes, moving said pair of guides relative to each other as each of said pair advances along non-parallel portions of said adjacent and pre-existing auger holes, guiding said mining machine such that said machine follows said adjacent and pre-existing auger holes, and mechanically engages and dislocated said hard material in-situ between said auger holes, carrying said hard material away from the position at which said material is dislocated by said machine; and withdrawing said mining machine from the space defined by said adjacent auger holes and the void space resulting from removing said hard material from between said holes upon completion of said driving operation.

* * * * *